United States Patent [19]

Guenin

[11] 4,113,422

[45] Sep. 12, 1978

[54] SMOKER'S LIGHTER

[75] Inventor: Andre Guenin, Petit-Lancy, Switzerland

[73] Assignee: La Nationale S.A., Geneva, Switzerland

[21] Appl. No.: 704,794

[22] Filed: Jul. 13, 1976

[30] Foreign Application Priority Data

Jul. 21, 1975 [CH] Switzerland ..... 9498/75

[51] Int. Cl.[2] ..... F23Q 2/38

[52] U.S. Cl. ..... 431/124; 431/344

[58] Field of Search ..... 431/321, 344, 130, 131, 431/142, 143, 150, 254, 276, 277, 124; 141/325, 326, 327, 18, 47

[56] References Cited

U.S. PATENT DOCUMENTS

| | | | |
|---|---|---|---|
| 2,727,376 | 12/1955 | Felt | 431/131 |
| 2,803,123 | 8/1957 | Owen | 431/344 |
| 2,847,843 | 8/1958 | Greenhouse et al. | 431/321 |
| 3,159,991 | 12/1964 | Maltner et al. | 431/130 |
| 3,263,456 | 8/1966 | Dexter | 431/131 |

FOREIGN PATENT DOCUMENTS

| | | | |
|---|---|---|---|
| 285,282 | 4/1927 | United Kingdom | 431/124 |

*Primary Examiner*—Edward G. Favors
*Assistant Examiner*—R. J. Charvat
*Attorney, Agent, or Firm*—Emory L. Groff, Jr.

[57] ABSTRACT

A smoker's lighter of flat elongate shape has an inset bottom in one of its narrow ends. In the bottom are two orifices, one with a filling valve and the other equipped for the adjustment or replacement of an element such as a flint. The bottom has a cover pivoted about an off-center axis outside a line joining the two orifices so that the cover can be pulled out and pivoted to give access to the orifices individually.

4 Claims, 3 Drawing Figures

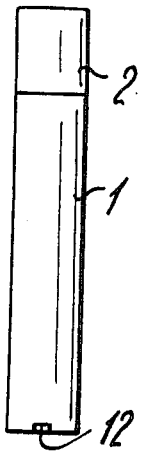
FIG. 1
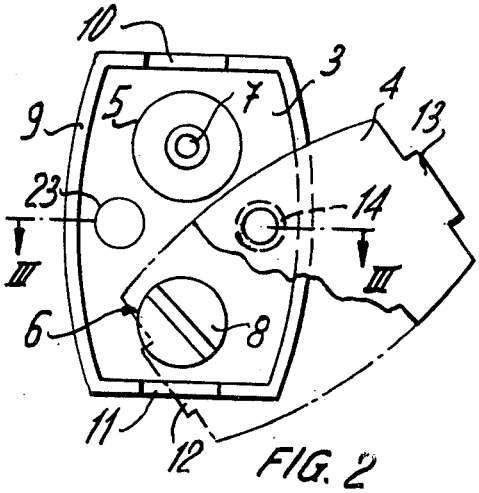
FIG. 2
FIG. 3
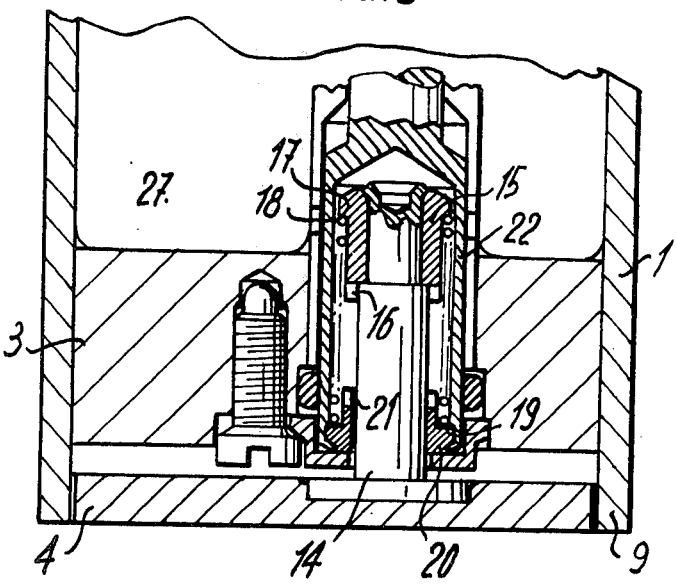

SMOKER'S LIGHTER

The invention relates to smoker's lighters of the type comprising a reservoir having a bottom into which two orifices open, one for filling the reservoir and the other for the adjustment or replacement of an element of the lighter, this bottom being covered by a rotatable cover carrying a pivot substantially perpendicular to said bottom and about which it can be turned, while remaining parallel to itself, to uncover the two orifices.

In known lighters of this type, the cover may be placed in a closed position in which both orifices are covered and an open position in which both orifices are uncovered. This arrangement is suitable only for lighters with a relatively large bottom which, generally, is of elongate or oblong shape.

The object of the present invention is to permit application of the principle of a rotatable cover to a lighter whose body is of a generally flat elongate shape and whose bottom is formed by one of the small faces of the body.

The lighter according to the invention is characterized in that the axis of the pivot passes outside a line joining the two orifices, this pivot being off-center in relation to the periphery of the cover so that in addition to a position covering the two orifices the cover can be brought into two other discrete positions in each of which it uncovers a respective one of the orifices.

The accompanying drawings show, schematically and by way of example, an embodiment of the lighter according to the invention. In the drawings:

FIG. 1 is a side elevational view of the lighter;

FIG. 2 is a view on a larger scale of the bottom of the lighter; and

FIG. 3 is a partial cross-section along line III—III of FIG. 2.

The lighter shown in FIG. 1 comprises a body 1 of generally flat elongate shape covered by a lid 2 tippably mounted at its upper end. The body 1 encloses a reservoir 27 for a combustible gas such as butane, and the lid 2 covers a burner and an ignition device, which are not shown as they may be of any type.

The lower end of body 1 has a bottom 3 covered by a rotatable cover 4 shown in greater detail in FIGS. 2 and 3. In the bottom 3 are two orifices 5 and 6, orifice 5 being equipped with a valve 7 permitting the filling and closing of reservoir 27 which is in part defined by body 1. The orifice 6 communicates with a channel, not shown, arranged to lead a flint up to the ignition device, and is closed by a screw 8 which, in a known manner, carries a spring biasing the flint against an ignition roller.

The bottom 3 is inset in the lower open end of body 1 whereby it is surrounded by a rim 9 formed by the lower edge of body 1. This rim 9 has two notches 10 and 11 receiving two protuberances 12 and 13 protruding laterally from cover 4. A pivot 14 is secured in the cover 4 and extends perpendicular to the principal planes of the bottom 3 and cover 4. The inner end of pivot 14 carries a sleeve 15 having a plurality of teeth 16 at one end and a shoulder 17 serving as support for one end of a coil spring 18 whose other end rests on a shoulder 19 of a sleeve 20 also having a plurality of teeth 21 disposed opposite the teeth 16 on the sleeve 15. The two sleeves 15 and 20 each form part of a coupling and are brought into engagement with one another by their respective teeth by a sufficient displacement of the pivot 14 against the action of spring 18. The sleeve 20 is fixed in a tube 22 which is extended by an actuating stem of a regulating element of the burner. The regulating device of the burner is not shown as it can be of any type and does not form part of the invention. It could for example be constructed as described in Swiss Patent Specification No. 326,667.

The periphery of the cover 4 (apart from the protuberances 12, 13) corresponds to the inner contour of the rim 9, so that in the closed position the cover 4 comes to engage inside the rim 9 flush with the lower edge of body 1.

To fill the reservoir 27, the cover 4 is disengaged from the rim 9 by grasping the protuberances 12 and 13 and pulling the cover 4 out against the action of spring 18. The cover 4 can be disengaged from the rim 9 by a displacement which is much less than that required to bring the teeth 16 and 21 into engagement with one another, so that it is possible to pivot the cover 4 to the position shown in a chain line in FIG. 2 without turning the tube 22 of the burner-regulating device. The valve 7 is thus uncovered and is accessible, while the screw 8 remains covered, due to the fact that the axis of pivot 14 passes outside a line joining the centers of the orifices 5 and 6. The axis of pivoting of the cover 4 is thus offset to the center of the periphery of cover 4.

To have access to the orifice 6, the cover 4 may be turned in the counter-clockwise direction from its position shown in a chain line in FIG. 2, to a position in which it covers the valve 7. In passing from one position to the other, at one point the cover occupies an intermediate position in which it has turned by 180° from its closed position. In this intermediate position, and in its positions uncovering the orifices 5 and 6, the cover 4 uncovers a third orifice 23 which may for example open into a cavity for spare flints.

As a variation, the orifice 23 could contain an element for regulating the burner flame and, in this case, the pivot 14 would of course no longer be equipped to enable it to carry out this regulation.

It is clear that the bottom of the lighter may have a greater number of orifices than three to meet operational or constructional requirements. Some orifices may, for example, receive screws for securing the bottom and which are made accessible by turning the cover.

I claim

1. A smoker's lighter comprising a reservoir having a bottom into which two orifices open, one for filing the reservoir and the other for the adjustment or replacement of an element of the lighter, a cover overlying said bottom, said cover carrying a pivot having an axis substantially perpendicular to said bottom and about which said cover can be rotated to uncover said two orifices while remaining parallel to itself, said axis of said pivot disposed outside a line joining the center point of said two orifices, said pivot disposed off-center in relation to the periphery of the cover so that in addition to a position covering the two orifices the cover can be brought into two other positions whereby in each one of said two other positions opposite ends of said cover respectively uncover and cover alternate ones of said two orifices.

2. A lighter according to claim 1 wherein, said pivot is disposed at a point on a transverse line between said two orifices.

3. A lighter according to claim 1, in which said bottom has at least three orifices, said cover being arranged to assume separate open positions to provide access to said orifices.

4. A smoker's lighter comprising a reservoir having a bottom into which two orifices open, one for filling the reservoir and the other for the adjustment or replacement of an element of the lighter, said bottom being covered by a rotatable cover carrying a pivot substantially perpendicular to said bottom and about which it can be rotated to uncover the two orifices and remain parallel to itself, the axis of the pivot passing outside a line joining the two orifices, said pivot being off-center in relation to the periphery of the cover so that in addition to a position covering the two orifices the cover can be brought into two other positions in each of which it uncovers a respective one of the orifices, a spring acting on said pivot and tending to bias the cover against the bottom, a rim surrounding said bottom , said cover being disposed within said rim when in its position covering said orifices, said cover including a protuberance, said rim having at least one notch for receiving said protuberance, said protuberance forming a gripping member for grasping the cover and bringing it into an orifice-uncovering position.

* * * * *